US005687468A

United States Patent [19]

Hans et al.

[11] Patent Number: 5,687,468

[45] Date of Patent: Nov. 18, 1997

[54] PROCESS FOR MANUFACTURING A MAGNETIC CIRCUIT FOR A VALVE

[75] Inventors: Waldemar Hans, Bamberg; Robert Schmidt-Hebbel, Hirschaid, both of Germany

[73] Assignee: Robert Bosch GmbH, Stuttgart, Germany

[21] Appl. No.: 646,244

[22] PCT Filed: Apr. 13, 1995

[86] PCT No.: PCT/DE95/00522

§ 371 Date: Sep. 11, 1996

§ 102(e) Date: Sep. 11, 1996

[87] PCT Pub. No.: WO96/08647

PCT Pub. Date: Mar. 21, 1996

[30] Foreign Application Priority Data

Sep. 13, 1994 [DE] Germany ..... 44 32 525.8

[51] Int. Cl.[6] ..... H01F 41/02

[52] U.S. Cl. ..... 29/602.1; 251/129.21

[58] Field of Search ..... 29/602.1; 251/129.21

[56] References Cited

FOREIGN PATENT DOCUMENTS 40 13 832 10/1991 Germany .
42 30 376 4/1993 Germany .

*Primary Examiner*—Carl E. Hall
*Attorney, Agent, or Firm*—Kenyon & Kenyon

[57] ABSTRACT

The process for manufacturing a magnetic circuit for a valve represents a particularly cost-effective version with minimized material use. For this purpose, a single-part valve housing has a groove, where a non-magnetic intermediate ring is placed. An axial pressing force is applied on the intermediate ring using a pressing tool, radially displacing the material of the intermediate ring and the valve housing. With a simple machining operation, valve house material is removed from an opening, so that the internal field and the valve jacket are spatially separated from the components obtained from the valve housing by the intermediate ring. The magnetic circuit thus manufactured is particularly well suited for fuel injection valves for fuel injection systems of internal combustion working with an externally ignited compressed mixture.

9 Claims, 4 Drawing Sheets

FIG. 8
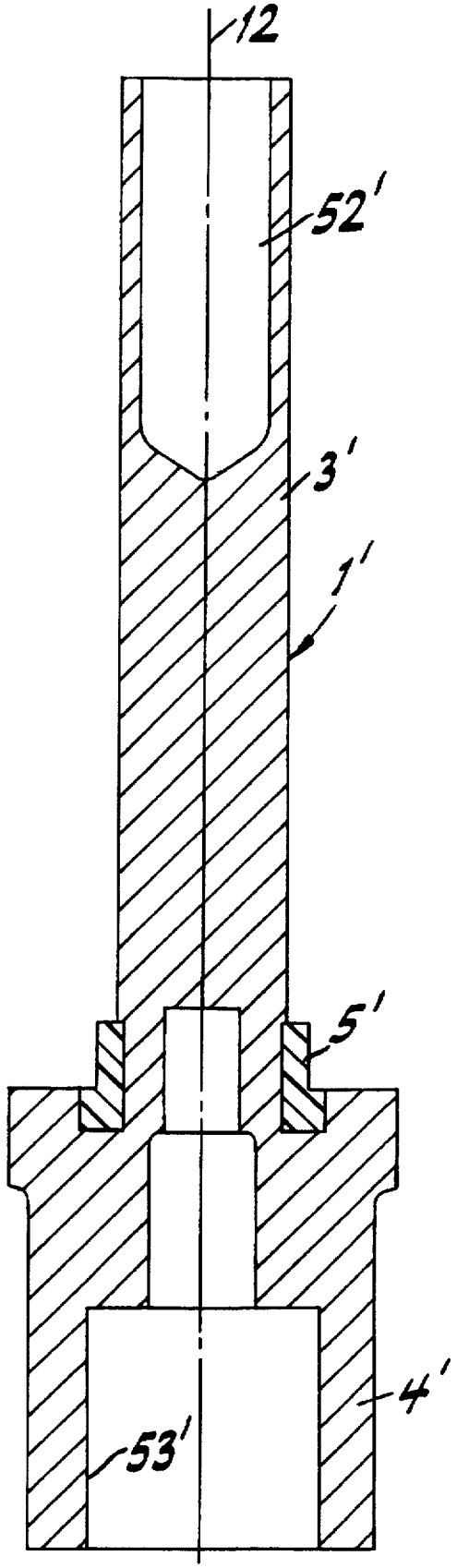
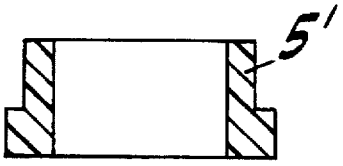
FIG. 7

PROCESS FOR MANUFACTURING A MAGNETIC CIRCUIT FOR A VALVE

FIELD OF THE INVENTION

The present invention is based on a process for manufacturing a magnetic circuit for a valve, specifically for an injection valve for fuel injection systems of internal combustion engines electromagnetically actuatable fuel injection valve wherein a connecting ring is made of a non-magnetic material having a high specific electric resistance, firmly and tightly connected with an internal field and a valve jacket of the fuel injection valve. Thus it is achieved that no fuel can reach a magnetic coil that surrounds the internal field which in turn is surrounded by the valve jacket between the internal field/valve jacket and the connection ring. Since the connecting ring is made of a non-magnetic material, the influence of the connecting ring on the magnetic field is very small; rather, it prevents a magnetic short-circuit between the internal field and the valve jacket, preventing additional eddy-current losses. Fitting the connecting ring, however, is a relatively cost-intensive process. For example, in order to create firm and tight connections, an additional internal ring and an external soldered ring are required for manufacturing the magnet from the internal field, valve jacket, and connecting ring.

Thus, for example, five individual parts are required for manufacturing the magnet. The individual components, internal field, valve jacket, and connecting ring, must be manufactured with a high precision and assembled prior to the joining process. The manufacture of the high-precision components and the assembly of the components until firm and tight connections are achieved are complicated and costly processes.

German Patent Application No. 42 30 376, concerning the same species, discloses, among other things, the metal injection molding (MIM) process for manufacturing a valve needle for an electromagnetically actuatable valve. In this process, a single-part actuator, consisting of an armature section and a valve sleeve section, is manufactured by the MIM process. The MIM process includes the manufacturing of molded parts from a metal powder with a binding agent, e.g., a plastic binding agent, for example, using conventional plastic injection molding machines and the subsequent removal of the binding agent and sintering of the remaining metal powder skeleton. Since the composition of the metal powder can be adapted to the optimum magnetic characteristics of the desired molded component in a simple manner, this process is well-suited not only for the manufacture of actuator components, such as valve needles, but also for the manufacture of magnetic circuits for valves. The magnetic circuit is made, in addition to the magnetic coil and the armature, of at least a core, an intermediate ring, and a nozzle holder as parts of the valve housing.

SUMMARY OF THE INVENTION

The process according to the present invention for manufacturing a magnetic circuit for a valve, specifically for a fuel injection valve, has the advantage that a magnet is created economically with fewer individual components than in the prior art. Also advantageous is that a plurality of high-precision components is no longer required, since only one single-part valve housing, for example, an extruded housing, is used as part of the magnet. The valve housing is designed so that an internal field, made later according to the process of the invention, and a valve jacket, also to be formed, are still connected due to the single-part design of the valve housing. The valve housing has, from the very beginning, an external contour that corresponds to the subsequent contours of the internal field and the valve jacket.

It is advantageous to place a non-magnetic, circular intermediate ring into a groove made in the valve housing. It is particularly simple to place the intermediate ring into the groove, since the groove provides a well-defined position for the intermediate ring. An extrusion effect is caused by an axial force from a pressing tool acting upon the intermediate ring. The force acting upon the intermediate ring creates a radial flow of the intermediate ring and the valve housing material, mostly at a right angle to the direction of the pressing tool's action, since the pressing tool is provided with free space for the flowing material. The material flow causes the intermediate ring to penetrate deeper into the material of the valve housing, creating a firm material connection. The creation of the final spatial separation between the internal field and the valve jacket is advantageous in that the excess material is simply and inexpensively removed, for example, by turning, in a valve housing opening.

The process according to the present invention for manufacturing a magnetic circuit for a valve, specifically for a fuel injection valve, has the advantage that a magnet can be manufactured in a simple and inexpensive manner. It is advantageous that, in the Metal Injection Molding process, a non-magnetic intermediate ring and a magnetic valve housing can be injection molded on a conventional plastic injection molding machine as molded components in a single operation. The composition of the metal powder used in each case can be adjusted for optimum magnetic properties of the magnet.

It is advantageous that the intermediate ring is made of a non-magnetic material having a high specific electrical resistance, so that the influence of the intermediate ring on the magnetic field is very small and additional eddy current losses are avoided.

Since the valve housing is of a single-part design from the very beginning, and even after the process steps according to the present invention it represents a single-part body with three components, the resulting pressure-tightness is especially advantageous. Thus, using a minimum amount of material, a pressure-tight magnetic circuit is obtained, which can be installed in the valve without sealing components such as O-rings, so that additional components can be omitted. The design of the valve housing according to the process of the present invention also allows a very simple magnetic coil design to be used, with the coil enclosed by the valve housing and a conducting element so that it remains dry and tight without requiring an additional coil holder.

It is advantageous to use a plastic binding agent in the MIM process, and to remove this binding agent from the molded component through thermal treatment of said molded component. In this manner the molded component forming the valve housing and the intermediate ring, which already has a high material density, can be manufactured in an especially simple manner.

It is further advantageous to subject the molded component to hot isostatic pressing after sintering, so that a particularly high material density of the valve housing is obtained.

BRIEF DESCRIPTION OF THE DRAWINGS

FIG. 7 shows an intermediate ring manufactured by the MIM process according to the present invention.

FIG. 8 shows a valve housing manufactured by the MIM process with an intermediate ring prior to fine machining.

DETAILED DESCRIPTION OF THE INVENTION

Figure 1:
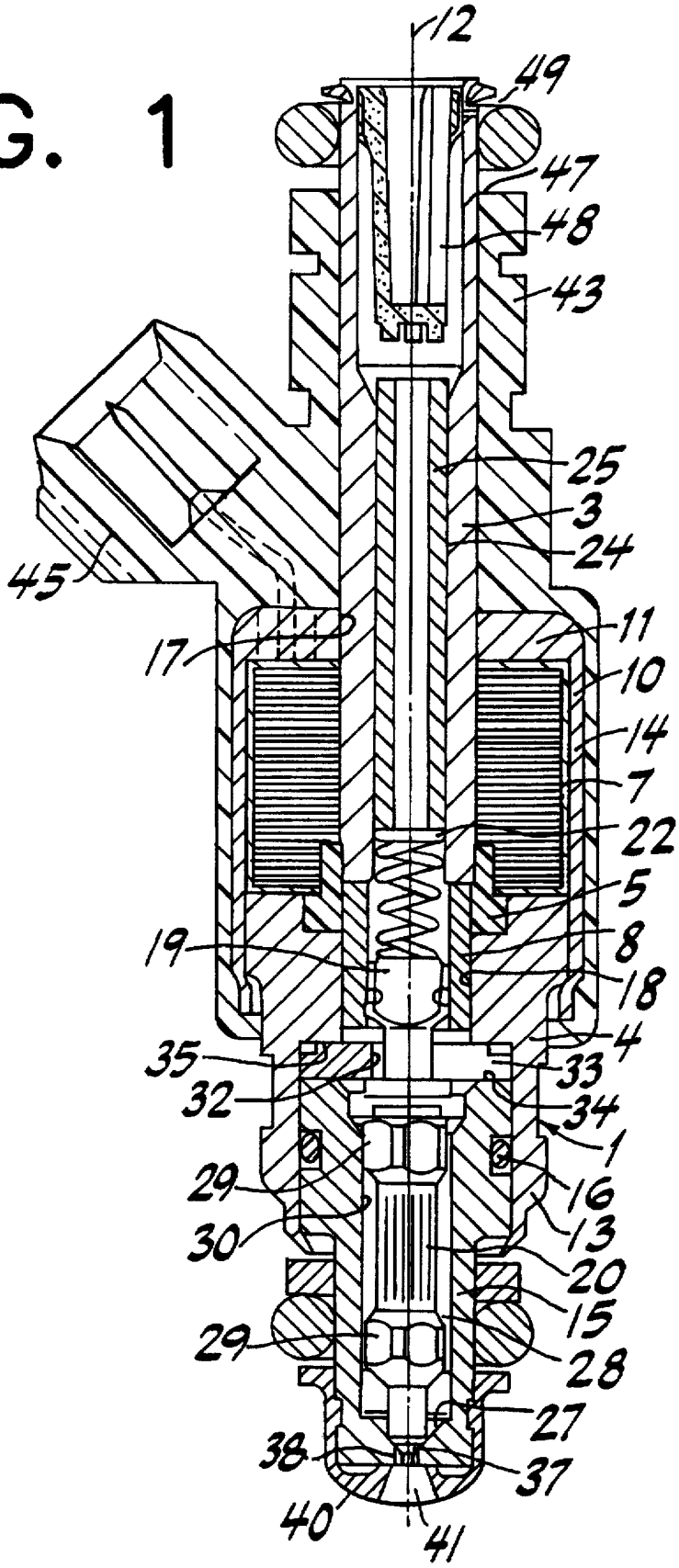
FIG. 1 shows a valve assembly according to the present invention.
Figure 2:
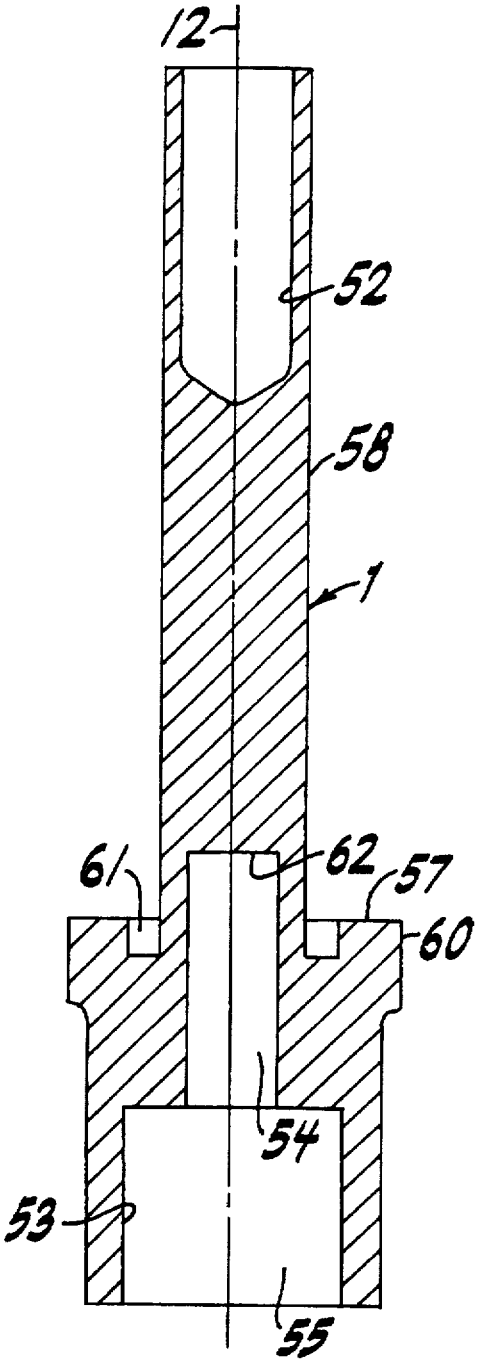
FIG. 2 shows a single-part valve housing according to the present invention

The electromagnetically actuatable fuel injection valve for fuel injection systems, for example, internal combustion engines working with externally ignited compressed mixtures, illustrated by way of an example in FIG. 1, has a tubular valve housing 1, obtained by the process of the present invention for manufacturing a magnetic circuit for a valve, encompassing two components, made of a ferromagnetic material, e.g., a soft magnetic steel. Prior to the use of the process according to the present invention, valve housing 1 represents a single-part ferromagnetic pressed part with a stepped contour, as shown in FIG. 2. As the individual process steps are described, the geometry of valve housing 1 is explained in detail. As a result of the process of the present invention, valve housing 1 has another configuration, which becomes especially obvious from its two-part structure. Namely, valve housing 1 is now formed by a tubular internal field 3 and a stepped tubular valve jacket 4, still serving as a housing. The spatial separation of internal field 3 arranged upstream and valve jacket 4 radially offset outward in relation to internal field 3 and continuing downstream is achieved by pressing in a non-magnetic intermediate ring 5. Before describing the process according to the present invention, we shall now briefly describe the construction of a fuel injection valve as an example.

The tubular internal field 3 has an approximately constant outer diameter and is partially surrounded by a magnetic coil 7. In addition to internal field 3 and magnetic coil 7, an armature 8 and a pot-shaped conducting element 10, enclosing magnetic coil 7 both partially in the radial direction and axially pertain to the electromagnetic circuit of the fuel injection valve. Magnetic coil 7 is fully embedded between internal field 3, conducting element 10, valve jacket 4, and finally intermediate ring 5 with an L-shaped cross section, without an additional coil holder.

Pot-shaped conducting element 10 is formed by a bottom part 11 turned away from armature 8, extending perpendicularly to a longitudinal valve axis 12, and a jacket part 14, following the former in the direction of valve jacket 4. Jacket part 14 fully surrounds magnetic coil 7 in the peripheral direction and is firmly attached to valve jacket 4 at its end opposite to the direction of the flow, e.g., through an edged connection. It is also possible that jacket part 14 is only partially formed in the peripheral direction, i.e., for example, it consists of a plurality of stirrup-shaped sections. Bottom part 11 of conducting element 10 partially covers magnetic coil 7 on its side turned away from armature 8. A through opening 17 is provided at the center of bottom part 11 for internal field 3. Pot-shaped conducting element 10 allows an especially compact construction of the injection valve in the area of magnetic coil 7. All the components mentioned so far of the injection valve are arranged concentrically to longitudinal valve axis 12. The tubular internal field 3, also concentric to longitudinal valve axis 12, represents a fuel inlet nozzle and thus serves for introducing fuel into the injection valve.

With its lower end 13, valve housing 1 (valve jacket 4) partially encloses, in the axial direction, a nozzle body 15. An annular groove is provided on the periphery of nozzle body 15 with a sealing ring 16 for hermetic sealing between valve housing 1 and nozzle body 15. The cylindrical hollow armature 8 works with magnetic coil 7 and internal field 3 and extends through a magnetic line shoulder 18 of valve jacket 4 and partly through non-magnetic intermediate ring 5 in the axial direction. Armature 8 surrounds, with its end turned away from magnetic coil 7, a support 19 of a valve needle 20 and is firmly connected to valve needle 20. One end of reset spring 22 adjoins one front side of support 19 turned toward magnetic coil 7. With its other end, reset spring 22 adjoins an adjusting sleeve 25 pressed, for example, into a through bore 24 of internal field 3o Tubular adjusting sleeve 25, made, for example, of rolled elastic steel sheet, is used for adjusting the pre-stress of reset spring 22 abutting on it. Reset spring 22 tends to move armature 8 and valve needle 20 connected with armature 8 in the direction of a valve seat surface 27.

Concentrically to the longitudinal valve axis 12, a stepped through flow channel 28 is formed in nozzle body 15. Flow channel 28 has tapered valve seat surface 27 at its end turned away from valve housing 1. Two typically quadrangular guide sections 29 of valve needle 20 are guided in a guiding area 30 of flow channel 28; they leave free, however, also an axial passage for the fuel.

Valve needle 20 extends, with a radial play, through opening 32 in a stop plate 33, pressed in between a front end 34 turned toward armature 8 of nozzle body 15 and an internal shoulder 35 of valve jacket 4, located opposite to front 34. Stop plate 33 is used for limiting the motion of valve needle 20 located in flow channel 28 of nozzle body 15.

Turned away from support 19, valve needle 20 has a tapered section 37, used as valve closure, which works in conjunction with tapered valve seat surface 27 of nozzle body 15 and effects the opening and closing of the fuel injection valve. In the direction of the flow, an end channel 38 of nozzle body 15 adjoins tapered valve seat surface 27. Typically an injection hole disk 40, with, for example, one ejection opening 41 produced by stamping or erosion, through which the fuel can be ejected, follows this end channel 38 in the downstream direction.

At least partially, internal field 3 and conducting element 10 are surrounded by a plastic jacket 43 in the axial direction. An electric connector 45, electrically contacting and thus exciting magnetic coil 7 is, for example, molded together with plastic jacket 43.

On its inlet end 47, internal field 3, used there as a fuel inlet nozzle, is shaped so that a fuel filter 48 can be installed. For this purpose, through bore 24 has a larger diameter upstream of adjusting sleeve 25 than in the area of pressed-in adjusting sleeve 25. Fuel filter 48 can be installed, for example, by pushing it into through bore 24 of internal field 3; it is in contact with and slightly pressing in the radial direction against the wall of through bore 24. The fuel entering the fuel injection valve flows through fuel filter 48 in a well-known manner and exits the fuel filter 48 in the radial direction.

In the following, the individual process steps for manufacturing a magnetic circuit with the components: internal field 3, valve jacket 4, and intermediate ring 5, will be described in detail using FIGS. 2 through 6. FIG. 2 shows the single-part valve housing 1, which, in the process according to the present invention is divided, for example, into internal field 3 and valve jacket 4 according to FIGS. 1 and 6. In a first process step, valve housing 1 is manufactured from a ferromagnetic material as a molded body so that the outer contours of internal field 3 and valve jacket 4, made later, can remain basically unmachined. In longitudinally extended valve housing 1, a pocket hole 52, as part of what will be through hole 24 in the area of fuel filter 48, and a stepped, pocket-like opening 53 on the side opposite to pocket hole 52, are provided.

Opening 53 has, in at least one of its axial sections 55, the proper diameter required for the installation of nozzle body 15 in section 55. The diameter required later for armature 8 cannot be provided immediately in axial section 54, turned toward pocket hole 52, of opening 53, since the material remaining radially outside section 54 will be in part necessary in the subsequent process steps. Magnetic line shoulder 18 is formed later from the internal wall of valve housing 1 in section 54. Since what is to become valve jacket 4, i.e., the area of valve housing 1 with internal opening 53, has a larger outer diameter than what is to become internal field 3, a radial shoulder 57 is formed in valve housing 1. Radial shoulder 57 forms the lower limit surface for the space of magnetic coil 7, while an outer wall 58 of internal field 3 represents the internal limit up to longitudinal valve axis 12 for magnetic coil 7. Radial shoulder 57 does not have a smooth surface from an outer jacket surface 60 of valve jacket 4 to wall 58, but is interrupted by annular groove 61, having its side walls parallel to longitudinal valve axis 12 and running along wall 58 in the direction of section 55. Section 54 of opening 53 extends in the direction of pocket hole 52 somewhat beyond radial shoulder 57 to a stop surface 62, so that what is to become valve jacket 4, is traversed entirely, and what is to become internal field 3, is traversed only partially in the axial direction by opening 53.

Figure 3:
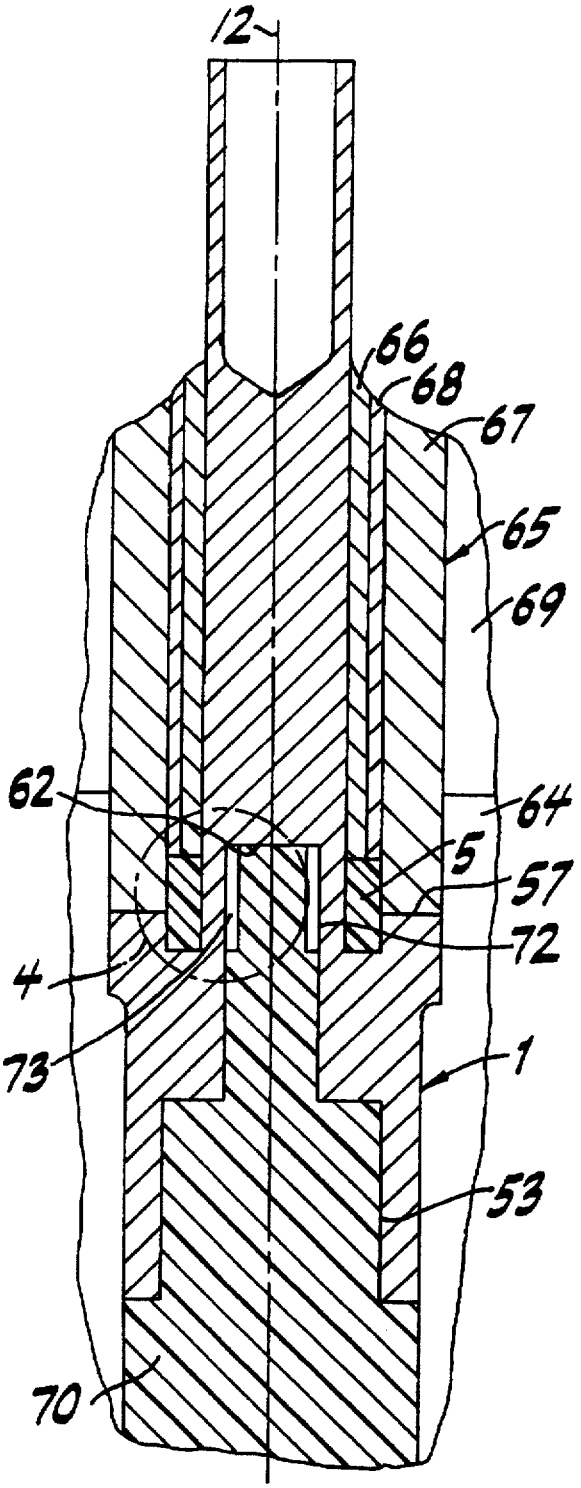
FIG. 3 shows a single-part valve housing with a non-magnetic intermediate ring in a pressing tool prior to extrusion according to the present invention.

In a subsequent process step, non-magnetic, corrosion-resistant intermediate ring 5, made, for example, of an austenitic steel, is pushed in over internal field 3 along wall 58 up to groove 61 and positioned there. FIG. 3 shows valve housing 1 after the installation of non-magnetic intermediate ring 5. Intermediate ring 5 is now pressed with a tool only schematically represented in FIG. 3. For this purpose, valve housing 1 is placed, together with valve jacket 4, into a first correctly shaped mold 64. A three-part sleeve-shaped punch 65 is used as the actual pressing tool. An internal support sleeve 66, directly surrounding wall 58 of internal field 3 and an external support sleeve 67 basically serve for guiding a pressing sleeve 68 enclosed between both and preventing non-magnetic intermediate ring 5 from being displaced during the pressing operation. Pressing punch 65 runs in a second matrix 69. The individual sleeves 66, 67, and 68 have a width such that internal support sleeve 66 and pressing sleeve 68 are in tight contact with intermediate ring 5, while external support sleeve 67 extends to radial shoulder 57 of valve housing 1. The actual force for pressing intermediate ring 5 is applied through pressing sleeve 68. Punch 70, introduced in opening 53, exerts an opposite force until it completely fills opening 53 up to its end area 72 near end surface 62. In this end area 72, punch 70 has a smaller diameter than opening 53, so that an annular, material-free space 73, necessary for pressing, is formed. Free space 73 is not only located in the same axial area of valve housing 1, but it also has approximately the same axial extension as intermediate ring 5.

Figure 4:
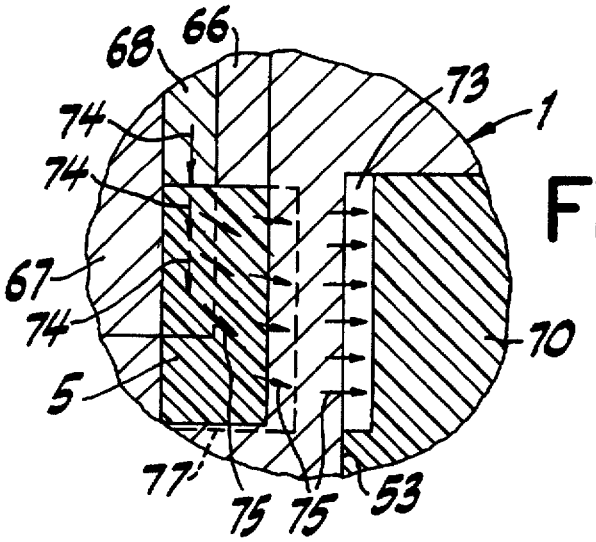
FIG. 4 shows magnified detailed of the circled area shown in FIG. 3.

The area circled in FIG. 3 around intermediate ring 5 and free space 73 is represented as a magnified view in FIG. 4. The arrows show the direction in which the material is moved and pressed. Thus, with pressing sleeve 68, a punching force designated with arrows 74, acting linearly, is applied to intermediate ring 5. Therefore, the extruding action is a translational pressure molding action. Extruding is performed as a cold-forming process. Due to the given free space 73, the material flows basically at a right angle to the direction of the pressing force, as shown by arrows 75, so that this can be called cross extrusion. The material of intermediate ring 5 and valve housing 1 is moved radially by pressing sleeve 68 penetrating into intermediate ring 5. The material flow in the axial direction is negligible. After pressing, the material of valve housing 1 fills free space 73 completely.

Intermediate ring 5 also obtains a different contour, since material is pressed radially in the direction of the longitudinal valve axis 12 into valve housing 1, so that an area 77 previously pertaining to valve housing 1, denoted by a dashed line, becomes part of intermediate ring 5 after extrusion. In the area of action of pressing sleeve 68, a depression is formed, whereby the cross-section of intermediate ring 5 becomes L-shaped. The materials of intermediate ring 5 and valve housing 1 become inextricably bound by pressing.

Figure 5:
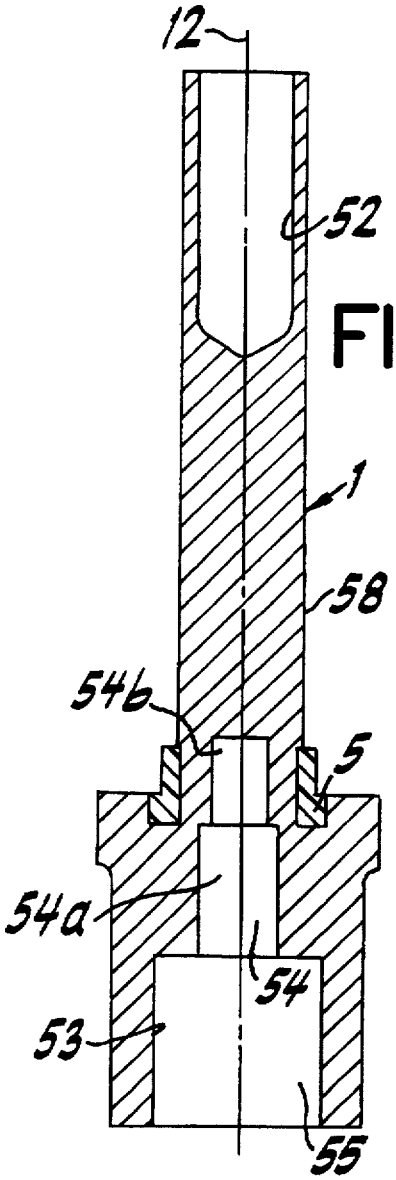
FIG. 5 shows a valve housing with an intermediate ring after extrusion according to the present invention.

FIG. 5 shows valve housing 1, together with intermediate ring 5 after extrusion. It can be seen that intermediate ring 5, now with an L-shaped cross section, protrudes slightly from wall 58 in the direction of valve axis 12. Due to the shape of punch 70 and the material flow that took place, axial section 54 of opening 53 is subdivided into two subsections **54*a* and 54*b*. The two subsections 54*a* and 54*b* have different diameters, the upper subsection 54*b* formed in the axial area of intermediate ring 5 having a smaller diameter than subsection 54*a* directly connected to section 55. In the finished valve housing 1, subsection 54*b* pertains, at least partially, to through bore 24**.

Figure 6:
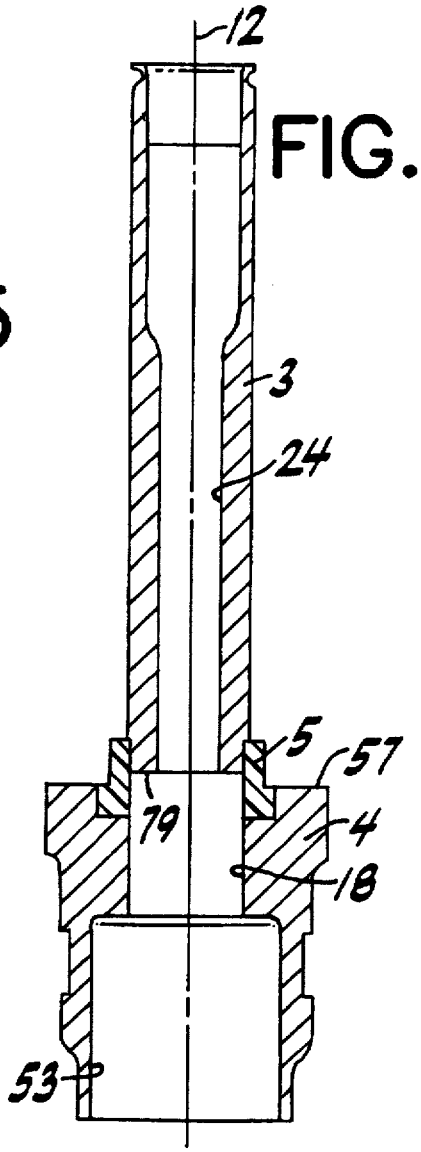
FIG. 6 shows a valve housing with an intermediate ring after spatial separation of the internal field and the valve jacket by fine machining.

In a last process step for the manufacture of a magnetic circuit for a valve, the valve housing 1 is fine machined (FIG. 6). The desired contours of valve housing 1 for installation in a fuel injection valve are achieved using cutting operations, such as turning. Thus, for example, through hole 24 is produced by connecting pocket hole 52 with subsection **54*b*. The outer contour of valve jacket 4 is also changed by removing material around the periphery in a desired manner. An especially important operation in the machining of valve housing 1 is the shaping of opening 53. A full spatial separation of internal field 3 from valve jacket 4 is achieved by partial radial widening of subsection 54*b* of opening 53 up to non-magnetic intermediate ring 5. While the diameter of section 55 may remain unchanged, the diameter of subsection 54*a* is fully enlarged and that of subsection 54*b* is partially enlarged. In the axial direction, however, section 55 is also enlarged. The contours to be achieved depend on the dimensions of nozzle body 15, stop plate 33, and armature 8. Finally, opening 53 has an axial length limited by a lower end surface 79 of internal field 3, which is located slightly farther upstream in the axial direction than radial shoulder 57, but still clearly in the area of intermediate ring 5** that surrounds it.

The final assembly of the fuel injection valve with single-part valve housing 1, manufactured according to the present invention, but now including two components, and the non-magnetic intermediate ring 5 is done in the well-known manner.

A second example of the manufacturing of a magnetic circuit for a valve is described below using FIGS. 7 and 8. The process now used is a metal injection molding process. The metal injection molding (MIM) process known from German Patent Application No. 42 30 376, among others, for the manufacturing of a valve needle includes the manufacturing of molded bodies from a metal powder with a binding agent, e.g., a plastic binding agent, using for example conventional plastic injection molding machines and the subsequent removal of the binding agent and sintering of the remaining metal powder skeleton. Parts corresponding in the example of embodiment shown in FIGS. 7 and 8 to those shown in FIGS. 1 through 6 are designated with the same reference numbers with an additional prime sign.

FIG. 7 shows intermediate ring 5', with an L-shaped cross-section, corresponding to intermediate ring 5. Non-magnetic intermediate ring 5' is injected, for example, on a conventional plastic injection molding machine in a single operation. For this purpose, metal powder (e.g., non-magnetic steel) is mixed with a plastic material used as a binding agent, homogenized, and prepared as a granulate, which is fed to the plastic injection molding machine. The injection molded intermediate ring 5' is obtained in the shape that corresponds to that of the mold.

In a subsequent operation, valve housing 1' (e.g., soft magnetic steel +binding agent) with the contour known from FIG. 5 is injection molded in the plastic injection molding machine on or around intermediate ring 5' (FIG. 8). Due to the simple pocket hole 52', which narrows inward into valve housing 1', and opening 53', injection molding can be accomplished with simple punches or pistons. Thus, after injection molding, valve housing 1' forms a single part with intermediate ring 5'. Subsequently the components of the plastic binding agent are removed from the now injection-molded component by a thermal process, e.g. under a protective gas blanket. Basically a metal powder skeleton remains. In order to increase the density of the molded body consisting of valve housing 1' and intermediate ring 5', the molded body is sintered, for example, under a protective gas blanket, in a sintering device. The sintering process can, however, also be performed in a hydrogen atmosphere or under vacuum. Valve housing 1', now having a diminished volume, is then subjected to finishing, as in the first example of embodiment, for example by machining. Thus valve housing 1', corresponding to valve housing 1 shown in FIG. 6, is obtained, which is therefore not illustrated again. The fuel injection valve is then assembled, with intermediate ring 5', around valve housing 1' in a well-known manner.

We claim:

1. A method for manufacturing a magnetic circuit for a valve having a longitudinal valve axis, the valve including an internal field and a valve jacket, the internal field and the valve jacket positioned substantially concentric with the longitudinal valve axis, the method comprising the steps of:

(a) forming a single-part valve housing having a magnetic property, the single-part valve housing having an external contour substantially corresponding to a predetermined contour of the internal field and the valve jacket;

(b) mounting an intermediate ring on the single-part valve housing, the intermediate ring including an intermediate ring material;

(c) placing the single-part valve housing in a pressing tool to form a free-space opening, the valve housing including a valve housing material;

(d) applying a force to the intermediate ring using the pressing tool, the force at least partially displacing the intermediate ring material and the valve housing material radially in the direction of the longitudinal valve axis, the intermediate ring material and the valve housing material being displaced into the free-space opening for binding the intermediate ring material with the valve housing material; and (e) radially-widening an internal opening in the valve housing up to the intermediate ring using a machining operation, the internal opening being radially-widened for separating the internal field from the valve jacket and for forming the external contour of the valve housing.

2. The method according to claim 1, wherein the intermediate ring has an austenitic steel material composition.

3. The method according to claim 1, wherein the pressing tool includes a sleeve-shaped pressing punch, a bore punch positioned in the internal opening, a first matrix and a second matrix, the sleeve-shaped pressing punch including a pressing sleeve, an internal sleeve internally limiting the pressing sleeve and an external sleeve externally surrounding the pressing sleeve, the first and second matrices substantially surrounding the valve housing, the sleeve-shaped pressing punch and the bore punch.

4. The method according to claim 3, wherein the force is applied to the intermediate ring with the pressing sleeve.

5. The method according to claim 4, wherein the step of applying the force includes using a translation pressure molding process, the translation pressure molding process being used at a room temperature.

6. The method according to claim 1, wherein the intermediate ring material and the valve housing material are displaced at a right angle to a pressing force direction of a pressing sleeve.

7. A method for manufacturing a magnetic circuit for a valve having a longitudinal valve axis, the valve including an internal field and a valve jacket, the internal field and the valve jacket positioned substantially concentric with the longitudinal valve axis, the method comprising the steps of:

(a) injection-molding an intermediate ring and a valve housing using a metal injection molding process, the intermediate ring being injection-molded with a granulate including a metal powder and a binding agent, the valve housing being injection-molded substantially at or with the intermediate ring to form a valve housing contour, the valve housing contour substantially corresponding to a predetermined contour of the internal field and the valve jacket;

(b) removing at least one component of the binding agent from the valve housing and the intermediate ring;

(c) sintering the valve housing and the intermediate ring; and (d) radially-widening an internal opening in the valve housing up to the intermediate ring using a machining operation, the internal opening being radially-widened for separating the internal field from the valve jacket and for forming the valve housing contour of the valve housing.

8. The method according to claim 7, wherein the step of injection-molding the intermediate ring and the valve housing is performed as a single operation using a plastic injection molding machine.

9. The method according to claim 7, wherein the binding agent has a plastic material composition.

* * * * *

UNITED STATES PATENT AND TRADEMARK OFFICE

CERTIFICATE OF CORRECTION

PATENT No. : 5,687,468

DATED : November 11, 1997

INVENTOR(S): Waldemar Hans et al.

It is certified that error appears in the above-identified patent and that said Letters Patent is hereby corrected as shown below:

Column 1, line 9, after "engines" insert --.--;

Column 1, line 9, after "engines." insert a new paragraph

--BACKGROUND INFORMATION

German Patent Application No. 40 13 832 relates to an--;

Column 2, line 67, after "invention" insert --.--;

Column 4, line 24, "3o" should be --3.--;

Column 7, line 29, "+binding" should be -- + binding--.

Signed and Sealed this

FourthDay of August, 1998

Bruce Lehman

*Attest:*

BRUCE LEHMAN

*Attesting Officer*

*Commissioner of Patents and Trademarks*